US009517367B2

(12) United States Patent
Dwyer et al.

(10) Patent No.: US 9,517,367 B2
(45) Date of Patent: Dec. 13, 2016

(54) RESPIRATORY MASK HAVING A CLEAN AIR INLET CHAMBER

(71) Applicant: 3M INNOVATIVE PROPERTIES COMPANY, St. Paul, MN (US)

(72) Inventors: Gary E. Dwyer, Mallorytown (CA); William A. Mittelstadt, Woodbury, MN (US); Carl W. Raines, III, Woodbury, MN (US); Nathan A. Abel, Minneapolis, MN (US); David M. Blomberg, Lino Lakes, MN (US); Michael J. Cowell, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 304 days.

(21) Appl. No.: 13/757,068

(22) Filed: Feb. 1, 2013

(65) Prior Publication Data

US 2014/0216473 A1 Aug. 7, 2014

(51) Int. Cl.

| | |
|---|---|
| ***A41D 13/11*** | (2006.01) |
| ***A62B 18/10*** | (2006.01) |
| ***A62B 18/02*** | (2006.01) |

(52) U.S. Cl.

CPC ..... *A62B 18/10* (2013.01); *A62B 18/025* (2013.01)

(58) Field of Classification Search

USPC ..... 128/833, 201.22, 201.23, 201.25

See application file for complete search history.

(56) References Cited

U.S. PATENT DOCUMENTS

| | | | |
|---|---|---|---|
| 3,167,070 | A | 1/1965 | Silverman |
| 4,414,973 | A | 11/1983 | Matheson |
| 4,574,799 | A | 3/1986 | Warncke |
| 4,790,306 | A | 12/1988 | Braun |
| 4,905,683 | A | 3/1990 | Cronjaeger |
| 4,981,134 | A | 1/1991 | Courtney |
| 5,299,448 | A | 4/1994 | Maryyanek |
| 5,372,130 | A | 12/1994 | Stern |
| 5,501,213 | A | 3/1996 | Jackson |
| 5,540,218 | A | 7/1996 | Jones |
| 5,579,761 | A | 12/1996 | Yuschak |
| 5,592,935 | A | 1/1997 | Elstran |

(Continued)

FOREIGN PATENT DOCUMENTS

| | | |
|---|---|---|
| GB | 591531 | 8/1947 |
| GB | 2 388 787 | 11/2003 |

(Continued)

OTHER PUBLICATIONS

Koken Website, *Particulate Respirators*, web literature, http://www.koken~ltd.co.jp/english/particulaterespirators.htm., pp. 1-4, obtained from internet Jun. 3, 2013.

(Continued)

*Primary Examiner* — Ophelia A Hawthorne

(57) ABSTRACT

A respiratory mask body defining a first chamber and a second chamber is provided. In an exemplary embodiment, the mask body includes one or more inlet ports adapted to receive one or more breathing air source components in communication with the first chamber and a fluid intake communication component allows communication of air from the first chamber to the second chamber during inhalation by a wearer.

17 Claims, 3 Drawing Sheets

(56) References Cited

U.S. PATENT DOCUMENTS

| | | | | |
|---|---|---|---|---|
| 5,647,356 | A | 7/1997 | Osendorf | |
| 5,647,357 | A | 7/1997 | Barnett | |
| 5,659,296 | A | 8/1997 | Doebe | |
| 5,669,375 | A | 9/1997 | Dahrendorf | |
| 5,687,767 | A | 11/1997 | Bowers | |
| 5,732,695 | A | 3/1998 | Metzger | |
| 5,803,076 | A | 9/1998 | Myers | |
| 5,937,857 | A | 8/1999 | Caterini | |
| 5,967,142 | A | 10/1999 | Dorcheh | |
| 6,016,802 | A | 1/2000 | Jackson | |
| 6,016,804 | A | 1/2000 | Gleason | |
| 6,167,882 | B1 | 1/2001 | Almqvist | |
| 6,196,223 | B1 | 3/2001 | Belfer | |
| 6,206,003 | B1 * | 3/2001 | Burch | 128/206.21 |
| 6,298,849 | B1 | 10/2001 | Scholey | |
| 6,408,845 | B1 | 6/2002 | Pereira | |
| 6,418,928 | B1 | 7/2002 | Bordewick | |
| 6,460,539 | B1 | 10/2002 | Japuntich | |
| 6,575,165 | B1 | 6/2003 | Cook | |
| 6,584,976 | B2 | 7/2003 | Japuntich | |
| 6,659,102 | B1 | 12/2003 | Sico | |
| 6,712,072 | B1 | 3/2004 | Lang | |
| 6,761,169 | B2 | 7/2004 | Eswarappa | |
| 6,817,362 | B2 | 11/2004 | Gélinas | |
| 6,854,464 | B2 | 2/2005 | Mukaiyama | |
| 6,874,499 | B2 | 4/2005 | Viner | |
| 6,883,518 | B2 | 4/2005 | Mittelstadt | |
| 6,886,559 | B2 | 5/2005 | McDonald | |
| 6,997,206 | B1 | 2/2006 | Klockseth | |
| 7,025,060 | B1 | 4/2006 | Nicholson | |
| 7,059,326 | B2 | 6/2006 | Heidmann | |
| 7,100,608 | B2 | 9/2006 | Brewer | |
| 7,114,496 | B1 | 10/2006 | Resnick | |
| 7,118,608 | B2 | 10/2006 | Lovell | |
| 7,121,279 | B2 | 10/2006 | Dennis | |
| RE39,493 | E | 2/2007 | Yuschak | |
| 7,171,966 | B2 | 2/2007 | Schrader | |
| 7,188,622 | B2 | 3/2007 | Martin | |
| 7,213,595 | B2 | 5/2007 | Capon | |
| 7,296,568 | B2 | 11/2007 | Capon | |
| 7,302,951 | B2 | 12/2007 | Mittelstadt | |
| 7,320,722 | B2 | 1/2008 | Mittelstadt | |
| 7,353,826 | B2 | 4/2008 | Sleeper | |
| 7,464,705 | B2 | 12/2008 | Tanizawa | |
| 7,543,584 | B2 | 6/2009 | Brookman | |
| 7,559,323 | B2 | 7/2009 | Hacke | |
| 7,584,751 | B1 | 9/2009 | Brooks, Jr. | |
| 7,587,929 | B2 | 9/2009 | Zielinski | |
| 7,650,884 | B2 | 1/2010 | Flannigan | |
| 7,669,599 | B2 | 3/2010 | Gunaratnam | |
| 7,762,258 | B2 | 7/2010 | Zollinger | |
| 7,827,990 | B1 | 11/2010 | Melidis | |
| 7,836,886 | B2 | 11/2010 | McDonald | |
| 7,849,856 | B2 | 12/2010 | Mittelstadt | |
| 7,866,319 | B2 | 1/2011 | Penton | |
| 7,997,275 | B2 | 8/2011 | Quinn | |
| 8,006,691 | B2 | 8/2011 | Kenyon | |
| 8,011,368 | B2 | 9/2011 | Crutchfield | |
| 8,066,006 | B2 | 11/2011 | Daugaard | |
| 8,069,853 | B2 | 12/2011 | Tilley | |
| 8,104,472 | B2 | 1/2012 | Henderson | |
| 8,118,026 | B2 | 2/2012 | Gebrewold | |
| 8,176,918 | B2 | 5/2012 | Teng | |
| 8,267,088 | B2 | 9/2012 | Steindorf | |
| 8,272,382 | B2 | 9/2012 | Howard | |
| 8,312,876 | B2 | 11/2012 | Mutze | |
| 8,327,850 | B2 | 12/2012 | Ng | |
| 8,336,547 | B1 | 12/2012 | Ritchie | |
| 8,342,180 | B2 | 1/2013 | Martin | |
| 8,365,771 | B2 | 2/2013 | Xue | |
| 8,402,966 | B2 | 3/2013 | Morgan, III | |
| 8,402,971 | B2 | 3/2013 | Scheiner | |
| 8,443,806 | B2 | 5/2013 | Morelli | |
| 8,460,423 | B2 | 6/2013 | Legare | |
| 8,496,005 | B2 | 7/2013 | McDonald | |
| 8,505,536 | B2 | 8/2013 | Kielow | |
| 8,528,559 | B2 | 9/2013 | Crutchfield | |
| 8,550,084 | B2 | 10/2013 | Ng | |
| 8,573,201 | B2 | 11/2013 | Rummery | |
| 8,631,792 | B2 | 1/2014 | Ho | |
| 8,678,003 | B2 | 3/2014 | Darkin | |
| 8,708,708 | B1 | 4/2014 | Carideo | |
| 8,720,443 | B2 | 5/2014 | Kooij | |
| 8,770,195 | B2 | 7/2014 | Stone | |
| 2002/0195108 | A1 * | 12/2002 | Mittelstadt et al. | 128/206.15 |
| 2004/0003810 | A1 * | 1/2004 | Templeton et al. | 128/201.22 |
| 2005/0085799 | A1 | 4/2005 | Luria | |
| 2006/0076012 | A1 | 4/2006 | Tanizawa | |
| 2006/0225738 | A1 | 10/2006 | Afentoulopoulos | |
| 2006/0283453 | A1 | 12/2006 | Haddad | |
| 2006/0283455 | A1 | 12/2006 | Walker | |
| 2007/0272169 | A1 | 11/2007 | Barney | |
| 2008/0135050 | A1 | 6/2008 | Hitchcock | |
| 2008/0178884 | A1 | 7/2008 | Gerson | |
| 2009/0044808 | A1 | 2/2009 | Guney | |
| 2009/0065729 | A1 | 3/2009 | Worboys | |
| 2009/0078264 | A1 | 3/2009 | Martin | |
| 2009/0107515 | A1 | 4/2009 | Gavriely | |
| 2009/0139526 | A1 | 6/2009 | Melidis | |
| 2009/0188506 | A1 | 7/2009 | Duke | |
| 2009/0217926 | A1 | 9/2009 | Hine | |
| 2009/0235934 | A1 | 9/2009 | Martin | |
| 2009/0266361 | A1 | 10/2009 | Bilger | |
| 2010/0108067 | A1 | 5/2010 | Walker | |
| 2010/0132714 | A1 | 6/2010 | Morelli | |
| 2010/0206311 | A1 | 8/2010 | Flannigan | |
| 2010/0218761 | A1 | 9/2010 | Flannigan | |
| 2010/0224194 | A1 | 9/2010 | Walker | |
| 2010/0269833 | A1 | 10/2010 | Gillotin | |
| 2010/0307506 | A1 | 12/2010 | Kielow | |
| 2010/0313891 | A1 | 12/2010 | Veliss | |
| 2011/0000481 | A1 | 1/2011 | Gumaste | |
| 2011/0100372 | A1 | 5/2011 | Betz | |
| 2011/0240027 | A1 | 10/2011 | Billingsley | |
| 2011/0290253 | A1 | 12/2011 | McAuley | |
| 2012/0042878 | A1 | 2/2012 | Woo | |
| 2012/0080035 | A1 | 4/2012 | Guney | |
| 2012/0167890 | A1 | 7/2012 | Insley | |
| 2012/0168658 | A1 | 7/2012 | Insley | |
| 2012/0199130 | A1 | 8/2012 | Euvrard | |
| 2012/0204879 | A1 | 8/2012 | Cariola | |
| 2012/0234326 | A1 | 9/2012 | Mazzone | |
| 2012/0260920 | A1 | 10/2012 | Choi | |
| 2013/0004358 | A1 | 1/2013 | Underwood | |
| 2013/0104900 | A1 | 5/2013 | Tobias | |
| 2013/0125896 | A1 | 5/2013 | Dwyer | |
| 2013/0133628 | A1 | 5/2013 | Fornara | |
| 2013/0133664 | A1 | 5/2013 | Startare | |
| 2013/0180523 | A1 | 7/2013 | Huggins | |
| 2013/0186394 | A1 | 7/2013 | Hallett | |
| 2013/0199520 | A1 | 8/2013 | Dhuper | |
| 2013/0228184 | A1 | 9/2013 | Lee | |
| 2013/0239972 | A1 | 9/2013 | McAuley | |
| 2013/0269513 | A1 | 10/2013 | Estirado Vera | |
| 2013/0298775 | A1 | 11/2013 | Fiet | |
| 2013/0319420 | A1 | 12/2013 | Danford | |
| 2013/0327323 | A1 | 12/2013 | Rubin | |
| 2014/0007888 | A1 | 1/2014 | Sanchez Talero | |
| 2014/0076325 | A1 | 3/2014 | Rosert | |
| 2014/0096768 | A1 | 4/2014 | Lee | |
| 2014/0096774 | A1 | 4/2014 | Olsen | |
| 2014/0190476 | A1 | 7/2014 | Stinton | |
| 2014/0216473 | A1 | 8/2014 | Dwyer | |
| 2014/0216474 | A1 | 8/2014 | Mittelstadt | |
| 2014/0216475 | A1 | 8/2014 | Blomberg | |

FOREIGN PATENT DOCUMENTS

| | | |
|---|---|---|
| KR | 2012-0000355 | 1/2012 |
| WO | WO 03/099385 | 12/2003 |
| WO | WO 2012/100116 | 7/2012 |
| WO | WO 2013/187278 | 12/2013 |
| WO | WO 2013/187279 | 12/2013 |

(56) References Cited

FOREIGN PATENT DOCUMENTS

OTHER PUBLICATIONS

International Application PCT/US2014/013139 Search Report dated Sep. 5, 2014.

* cited by examiner

RESPIRATORY MASK HAVING A CLEAN AIR INLET CHAMBER

TECHNICAL FIELD

This disclosure relates to a respiratory protection device, in particular a mask body of a respiratory protection device defining a first air chamber in communication with first and second air inlet ports, and a second chamber defining a breathable air zone for a wearer.

BACKGROUND

Respiratory protection devices commonly include a mask body and one or more filter cartridges that are attached to the mask body. The mask body is worn on a person's face, over the nose and mouth, and may include portions that cover the head, neck, or other body parts in some cases. Clean air is made available to a wearer after passing through filter media disposed in the filter cartridge. In negative pressure respiratory protection devices, air is drawn through a filter cartridge by a negative pressure generated by a wearer during inhalation. Air from the external environment passes through the filter medium and enters an interior space of the mask body where it may be inhaled by the wearer.

Various techniques have been used to attach filter cartridges or elements to a respirator. Filter cartridges are commonly connected to an inlet port of a mask body via a threaded engagement, bayonet engagement, or other engagement, for example. In the case of dual cartridge respiratory protection devices, in which two cartridges are provided to filter air for a wearer, the filter cartridges are often connected to air inlets located proximate each cheek portion of the mask, away from a central portion of the mask, such that the cartridges extend outward at sides of the wearer's head. Inhalation check valves are commonly provided for each air inlet, such that air may be delivered from the filter cartridge into the breathing zone through the air inlet away from a central portion, and proximate each cheek portion of the mask body for example.

SUMMARY

The present disclosure provides for a respiratory mask including a mask body defining first and second chambers and having first and second inlet ports adapted to receive first and second breathing air source components and a fluid intake communication component. The first chamber is in fluid communication with the first and second inlet ports and the second chamber defines a breathable air zone for a wearer, and the fluid intake communication component is configured to allow communication of air from the first chamber to the second chamber through an inhalation port during inhalation by a wearer. In an exemplary embodiment, the mask body comprises a central axis that divides the mask body into left and right halves and the fluid intake communication component is positioned proximate the central axis.

The present disclosure further provides a negative pressure respiratory mask, including a mask body having first and second chambers and first and second inlet ports, first and second filter cartridges attached to the mask body at the first and second inlet ports, an inner wall dividing the first chamber from the second chamber, and an inhalation valve positioned on the inner wall at a central portion of the mask body The first and second filter cartridges each have an outlet in fluid communication with the first chamber, the second chamber defines a breathable air zone for a wearer, and the inhalation valve allows communication of air from the first chamber to the second chamber during inhalation by a wearer.

The above summary is not intended to describe each disclosed embodiment or every implementation. The Figures and the Detailed Description, which follow, more particularly exemplify illustrative embodiments.

BRIEF DESCRIPTION OF DRAWINGS

The disclosure may be further explained with reference to the appended Figures, wherein like structure is referred to by like numerals throughout the several views, and wherein.

While the above-identified figures set forth various embodiments of the disclosed subject matter, other embodiments are also contemplated. In all cases, this disclosure presents the disclosed subject matter by way of representation and not limitation. It should be understood that numerous other modifications and embodiments can be devised by those skilled in the art which fall within the scope and spirit of the principles of this disclosure.

DETAILED DESCRIPTION

The present disclosure provides a respiratory protection device having a mask body that defines first and second chambers and includes one or more inlet ports configured to receive one or more breathing air source components in fluid communication with the first air chamber. The first chamber allows air entering from the one or more inlet ports to mix and be directed to a desired location within the mask body. A fluid intake communication component, such as an inhalation valve, allows communication of air from the first chamber to the second chamber during inhalation by a wearer. In some exemplary embodiments, air from each of the one or more breathing air source components, such as filter cartridges, enters the second chamber defining a breathable air zone for a wearer through a single fluid intake communication component.

Figure 1A:
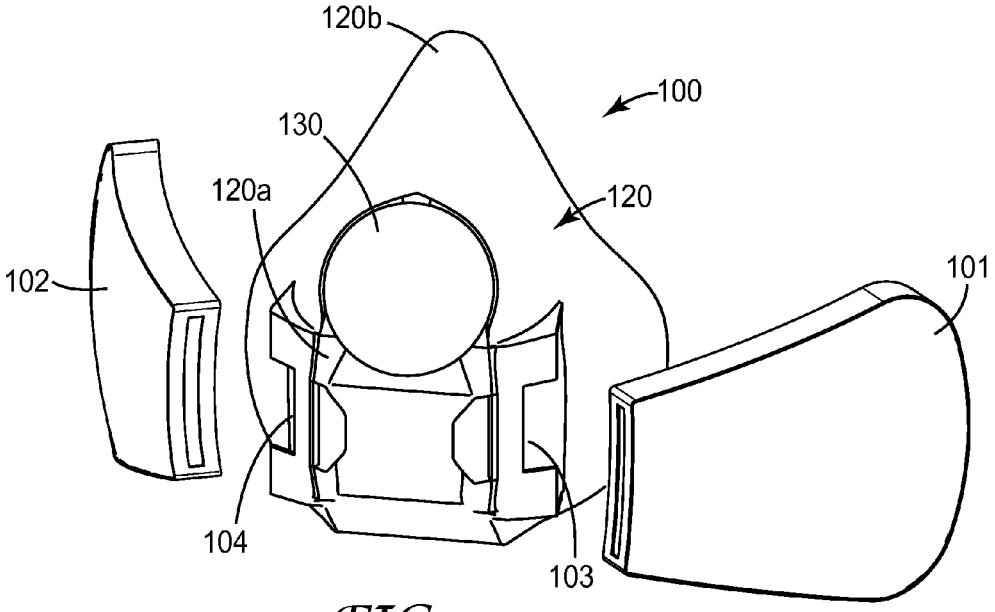
FIG. 1*a* is a front perspective view of an exemplary respiratory protection system according to the present disclosure.
Figure 1B:
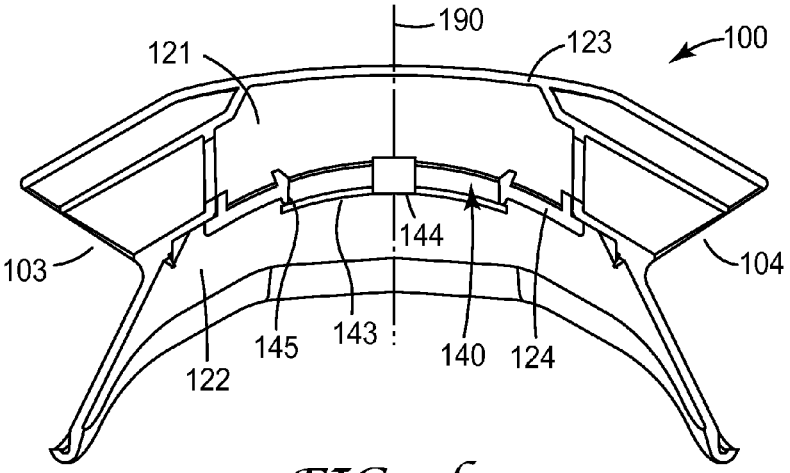
FIG. 1*b* is a partial cross-sectional view of an exemplary embodiment of a respiratory protection device according to the present disclosure including a mask body having first and second chambers.

FIGS. 1*a* and 1*b* illustrate an example of a respiratory protection device 100 that may cover the nose and mouth and provide breathable air to a wearer. The respiratory protection device 100 includes a mask body 120 including first and second inlet ports 103 and 104. First and second breathing air source components 101 and 102 may be positioned on opposing sides of mask body 120. In an exemplary embodiment, first and second breathing air source components are filter cartridges configured to be attached at first and second inlet ports 103 and 104. The filter cartridges 101, 102 filter air received from the external environment before the air passes into an interior space within the mask body for delivery to a wearer.

The mask body 120 may include a rigid or semi-rigid portion 120*a* and a compliant face contacting portion 120*b*. The compliant face contacting portion of the mask body is compliantly fashioned for allowing the mask body to be comfortably supported over a person's nose and mouth and/or for providing an adequate seal with the face of a wearer to limit undesirable ingress of air into an interior of mask body 120, for example. The face contacting member 120*b* may have an inturned cuff so that the mask can fit comfortably and snugly over the wearer's nose and against the wearer's cheeks. The rigid or semi-rigid portion 120*a* provides structural integrity to mask body 120 so that it can properly support breathing air source components, such as filter cartridges 101, 102, for example. In various exemplary embodiments, mask body portions 120*a* and 120*b* may be provided integrally or as separately formed portions that are subsequently joined together in permanent or removable fashion.

An exhalation port 130 allows air to be purged from an interior space within the mask body during exhalation by a wearer. In an exemplary embodiment, exhalation port 130 is located centrally on mask body 120. An exhalation valve is fitted at the exhalation port to allow air to exit due to positive pressure created within mask body 120 upon exhalation, but prevent ingress of external air.

A harness or other support (not shown) may be provided to support the mask in position about the nose and mouth of a wearer. In an exemplary embodiment, a harness is provided that includes one or more straps that pass behind a wearer's head. In some embodiments, straps may be attached to a crown member supported on a wearer's head, a suspension for a hard hat, or another head covering.

First and second inlet ports 103, 104 are configured to receive first and second breathing air source components 101, 102. In an exemplary embodiment shown in FIG. 1*a*, mask body 120 includes first and second inlet ports 103, 104 on either side of mask body 120, and may be proximate cheek portions of mask body 120. First and second inlet ports 103, 104 include complementary mating features (not shown) such that first and second breathing air source components 101, 102 may be securely attached to mask body 120. Other suitable connections may be provided as known in the art. The mating features may result in a removable connection such that the breathing air source components 101, 102 may be removed and replaced at the end of service life of the breathing air source component or if use of a different breathing air source component is desired. Alternatively, the connection may be permanent such that the breathing air source components cannot be removed without damage to the breathing air source component, for example.

FIG. 1*b* shows a representative cross-sectional view of an exemplary mask body 120 through a middle portion of mask body 120*a*. Exemplary mask body 120 includes a first chamber 121 and a second chamber 122. First and second breathing air source components, such as breathing air source components 101, 102, may be attached to first and second inlet ports 103, 104. First and second inlet ports 103, 104 are in fluid communication with first chamber 121. Accordingly, air entering mask body 120 through first inlet port 103 after passing through first breathing air source component 101 is in communication with air entering mask body 120 through second inlet port 104 after passing through second breathing air source component 102. Air from first and second breathing air sources 101, 102 is thus allowed to mix in first chamber 121 before being delivered to the breathable air zone defined by second chamber 122 of mask body 120.

In an exemplary embodiment, first and second chambers 121, 122 are separated by an inner wall 124 having a fluid intake communication component 140. Fluid intake communication component 140 comprises one or more openings to provide fluid communication between first and second chambers 121, 122. Fluid intake communication component 140 may include an inhalation valve for selectively allowing fluid communication between first and second chambers 121, 122, as described in greater detail below.

First chamber 121 is defined by one or more walls of mask body 120 and may exhibit any desired shape. In an exemplary embodiment, first chamber 121 is defined in part by an outer wall 123 that is an outer wall of mask body 120, and an inner wall 124. First chamber 121 is substantially sealed from the external environment with the exception of one or more inlet ports, such as first and second inlet ports 103, 104 extending through outer wall 123.

A chamber defined, at least in part, by the walls of mask body 120 and integrally formed with mask body 120, or rigid or semi-rigid portion 120*a*, provides a chamber within the structure of mask body 120 that may be configured to minimize extra bulk or weight that can be associated with a chamber separate from a mask body. Further, a chamber can be provided in close proximity to the head of a wearer such that the profile of the respiratory protection device is not greatly increased, minimizing a large moment of inertia away from the head of a wearer that could be perceived to cause neck pain or other discomfort for a wearer.

Second chamber 122 is similarly defined by one or more walls of mask body 120 and may exhibit any suitable shape defining a breathable air zone about the nose and mouth of a wearer. In an exemplary embodiment, second chamber 122 is defined in part by inner wall 124, a portion of outer wall 123, and, when respiratory protection device 100 is positioned for use on a wearer, a portion of a wearer's face and/or head. In various embodiments, inner wall 124 separates an interior space defined by outer wall 123 into first chamber 121 and second chamber 122, including a portion of outer wall 123 in front of inner wall 124 partially defining the first chamber 121, and a portion of outer wall 123 nearer to the face of a wearer partially defining the second chamber 122.

In an exemplary embodiment, first chamber 121 may function as a duct to direct air from an inlet port, such as first or second inlet ports 103, 104, to a different location in mask body 120. While many traditional respiratory masks deliver clean air from a cartridge through an inlet port and into the mask body at the location of the inlet port, first chamber 121 allows inlet ports 103, 104 to be positioned generally independent of fluid intake communication component 140. In an exemplary embodiment, inlet ports 103, 104 are positioned near cheek portions of mask body 120, and fluid intake communication component 140 is positioned centrally. For example, fluid intake communication component is positioned proximate a central axis extending through the mask and dividing mask body 120 into imaginary left and right halves, such as axis 190. Such a component may be said to be centrally positioned if some portions of the component are positioned on each side of axis 190. A configuration in which inlet ports 103, 104 are positioned near cheek portions while a fluid intake communication component 140 is centrally located may allow a breathing air source component to be received in a desirable position and/or orientation, for example extending rearwardly along the face of a wearer so as to minimize obstruction to the field of view or maintain the center of mass of the cartridge in close proximity to the mask body 120 and/or face of the wearer. Fluid intake communication component 140, however, may still be positioned centrally so as to deliver clean air in close proximity to the nose and mouth of a wearer, and in an exemplary embodiment is provided at an upper central location. Thus, first chamber 121 allows first and second breathing air source components to be positioned to provide desired ergonomic characteristics, and allows fluid intake communication component 140 to be positioned to provide desirable airflow to the wearer, for example. Further, first chamber 121 allows first and second inlet ports to be in fluid communication with a single fluid intake communication component. A respiratory protection device having two or more breathable air source components and a single fluid intake communication component can reduce manufacturing costs and provide a more robust respiratory protection device. Costly fluid intake communication components can be minimized, and the use of relatively fragile diaphragms or flaps may be reduced.

In an exemplary embodiment, inner wall 124 includes a fluid intake communication component including an inhalation port 141 to allow fluid communication between first chamber 121 and second chamber 122. Fluid intake communication component 140 allows air to be drawn into the second chamber from the first chamber during inhalation but prohibits air from passing from the second chamber into the first chamber. In an exemplary embodiment, fluid intake communication component 140 includes a diaphragm or flap 143. The diaphragm or flap 143 may be secured by a central pin 144, or at a peripheral edge or another suitable location as known in the art. In the absence of negative pressure within second chamber 122 of mask body 120, such as when a wearer is exhaling for example, the diaphragm is biased towards a surface of fluid intake communication component, such as sealing ring 145. During inhalation by a wearer, negative pressure within second chamber 122, that is a pressure lower than the pressure of the external atmosphere, may result in diaphragm or flap 143 being in an open position to allow air to enter second chamber 122 from first chamber 121. That is, diaphragm or flap 143 flexes or moves away from sealing ring 145 such that air may pass into second chamber 122 to be inhaled by a wearer. In various exemplary embodiments, fluid intake communication component 140 may include two or more inhalation ports and/or two or more diaphragms or flaps 143 to selectively allow fluid communication from first chamber 121 to first chamber 122 when pressure in second chamber 122 is negative.

FIGS. 2*a* through 2*d* illustrate an exemplary embodiment of a respiratory protection device 200 including a shut-off valve 250. Similar to respiratory protection device 100 described above with reference to FIGS. 1*a* and 1*b*, respiratory protection device 200 includes a mask body 220 including first and second inlet ports 203 and 204. First and second breathing air source components 201 and 202 may be positioned on opposing sides of mask body 220. In an exemplary embodiment, first and second breathing air source components 201 and 202 are filter cartridges configured to be attached at first and second inlet ports 203 and 204. The filter cartridges 201, 202 filter air from the external environment before the air passes into a first chamber 221 and through a fluid intake communication component and into a second chamber 222, of mask body 220, for delivery to a wearer.

Respiratory protection device 200 includes a shut-off valve 250 for manually closing a fluid intake communication component. In an exemplary embodiment, shut-off valve 250 is operable between a closed position and an open position. In a closed position, shut-off valve 250 prevents fluid communication between both of breathing air source components 201 and 202 and a breathable air zone of mask body 220. In an exemplary embodiment, shut-off valve blocks one or more inhalation ports 241 of a fluid intake communication component 240 to prevent communication of air from first chamber 221 to second chamber 222.

Shut-off valve 250 allows a wearer to perform a negative pressure fit check to provide an indication of the presence of leaks around a periphery of the mask body. When shut-off valve 250 is in a closed position, air inlet ports 203 and 204 may remain in fluid communication with first chamber 221, but air is not able to enter a breathable air zone of mask body 220 defined by second chamber 222. Inhalation by a wearer while the shut-off valve is in a closed position will result in a negative pressure within the mask, and in some exemplary embodiments may cause a compliant face contacting member to deflect inward, if an adequate seal has been achieved between the mask body and the wearer's face. If an adequate seal is not achieved, inhalation may result in air from the external environment entering the breathable air zone defined by second chamber 222 between the periphery of the mask body and the face of the wearer. In this way, a negative pressure fit check can be easily performed by a user wearing respiratory protection device 200 to determine if an adequate seal is achieved between the respiratory protection device 200 and the face and/or head of the wearer.

Figure 2A:
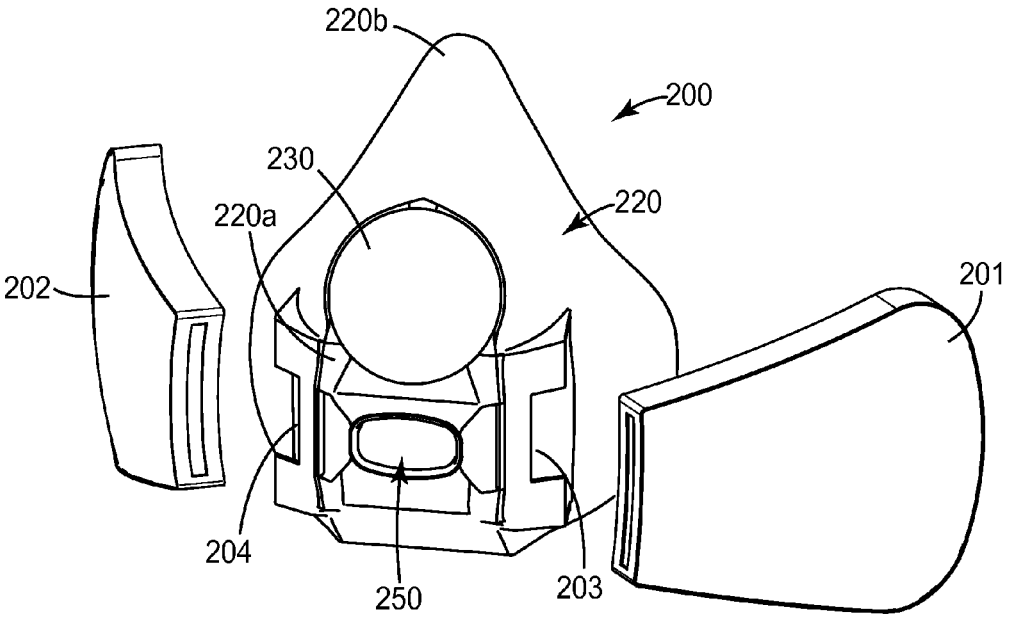
FIG. 2*a* is a front perspective view of an exemplary respiratory protection system according to the present disclosure including a shut-off valve.
Figure 2B:
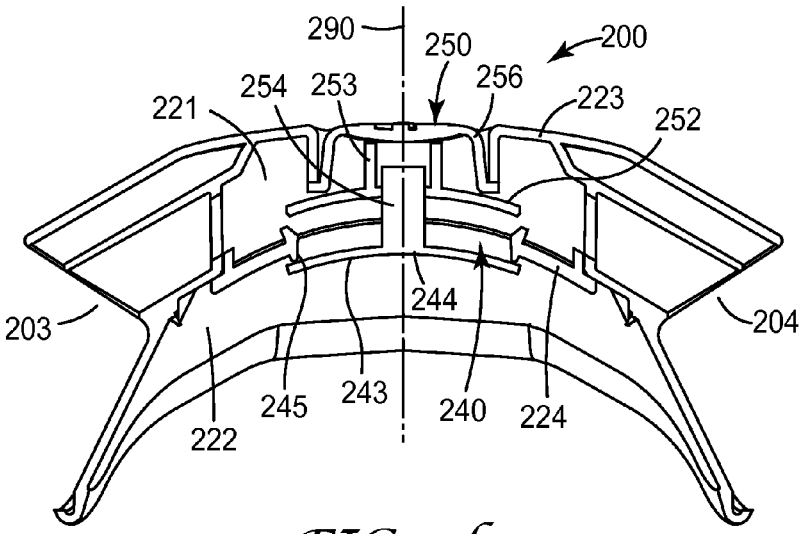
FIG. 2*b* is a partial cross-sectional view of an exemplary embodiment of a respiratory protection device according to the present disclosure including a mask body having first and second chambers and a shut-off valve.
Figure 2C:
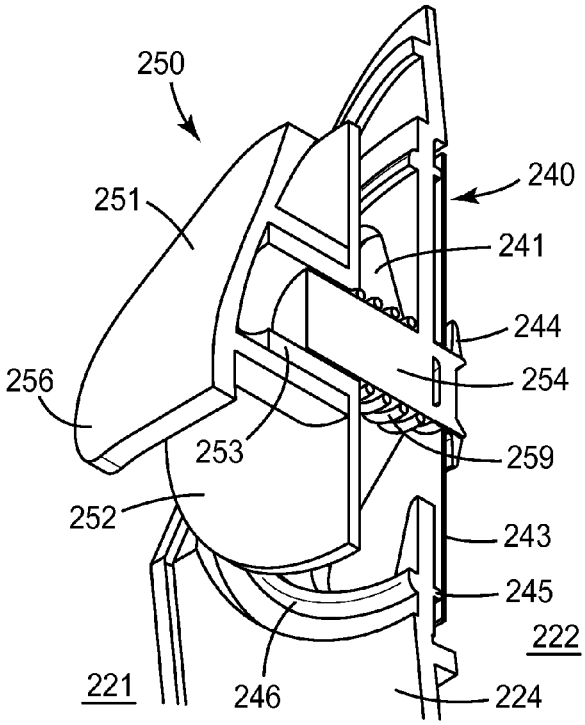
FIG. 2*c* is a partial cross-sectional perspective view of an exemplary embodiment of a respiratory protection device according to the present disclosure including a mask body having first and second chambers and a shut-off valve in an open position.

FIG. 2*b* shows a representative cross-sectional view of an exemplary mask body 220 through a middle portion of mask body 220. Exemplary mask body 220 includes a first chamber 221 and a second chamber 222. First and second inlet ports 203, 203 are in fluid communication with first chamber 221. Accordingly, air entering mask body 220 through first inlet port 203 after passing through first breathing air source component 201 is in communication with air entering mask body 220 through second inlet port 204 after passing through second breathing air source component 202. Air from first and second breathing air sources 201, 202 is thus allowed to mix in first chamber 221 before being delivered to second chamber 222 of mask body 220.

In an exemplary embodiment, first and second chambers 221, 222 are separated by an inner wall 224 having a fluid intake communication component 240. Fluid intake communication component 240 comprises one or more openings to provide fluid communication between first and second chambers 221, 222. Fluid intake communication component 240 may include an inhalation valve for selectively allowing fluid communication between first and second chambers 221, 222, similar to fluid intake communication component 140, described above.

In an exemplary embodiment, fluid intake communication component 240 includes an inhalation port 241 to allow fluid communication between first chamber 221, where air from the first and second breathing air sources may mix, and second chamber 222, defining a breathable air zone. Fluid intake communication component 240 allows air to be drawn into the second chamber from the first chamber during inhalation but prohibits air from passing from second chamber 222 into first chamber 221. In an exemplary embodiment, fluid intake communication component 240 includes a diaphragm or flap 243. The diaphragm or flap 243 may be secured at a central location 244 by a central pin or flange, or at a peripheral edge or other suitable location as known in the art. In the absence of negative pressure within second chamber 222 of mask body 220, such as when a wearer is exhaling for example, the diaphragm is biased towards a surface of fluid intake communication component, such as sealing ring 245. During inhalation by a wearer, negative pressure within second chamber 222 results in diaphragm or flap 243 being in an open position to allow air to enter second chamber 222 from first chamber 221. That is, diaphragm or flap 243 flexes or moves away from sealing ring 245 such that air may pass through inhalation port 241 and into second chamber 222 to be inhaled by a wearer. In various exemplary embodiments, fluid intake communication component 240 may include multiple inhalation ports 241 and/or two or more diaphragms or flaps 243 to selectively allow fluid communication from first chamber 221 to first chamber 222 when pressure in second chamber 222 is negative.

In an exemplary embodiment, shut-off valve 250 of mask body 220 includes an actuator 251 and sealing pad 252. In a closed position, sealing pad 252 contacts inner wall 224 to block inhalation port 241 to prevent fluid communication between the two or more breathing air sources and the breathable air zone second chamber 222. When shut-off valve 250 is in a closed position, air from breathing air source components 201, 202 is in fluid communication with first chamber 221 but is prevented from entering the breathable air zone defined by second chamber 222 through fluid intake communication component 240. In an exemplary embodiment, sealing pad 252 contacts a sealing surface 246 surrounding inhalation port 241. Sealing surface 246 may be in the form of a ridge or projection extending outwardly from inner wall 224 to allow an adequate seal to be performed around an entire periphery of inhalation port 241.

Sealing pad 242 may be formed of a soft or resilient material such that sealing pad may flex upon contacting sealing surface 246. In an exemplary embodiment, sealing pad 252 includes seating features, such as angled or flanged lips (not shown), to facilitate an adequate seal with sealing surface 246. All or a portion of sealing pad 242 may also articulate or rotate when contacting sealing surface 246. A sealing pad that may flex and/or articulate or rotate may facilitate formation of an adequate seal around inhalation port 241.

Figure 2D:
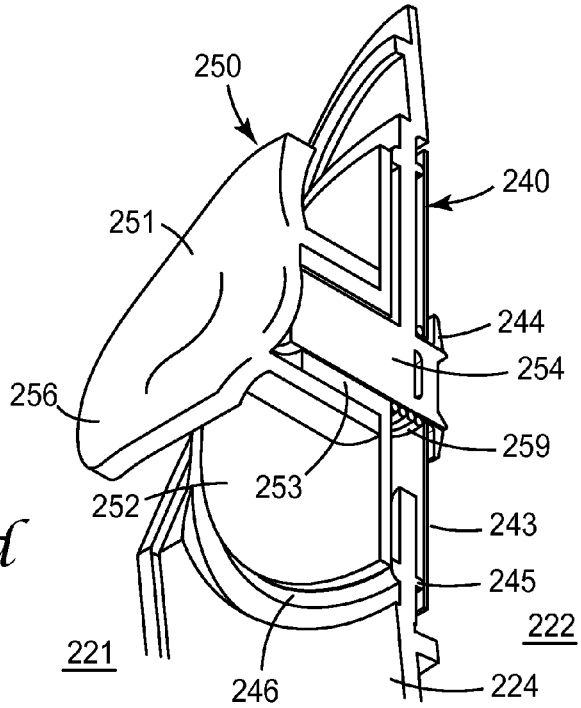
FIG. 2*d* is a partial cross-sectional perspective view of an exemplary embodiment of a respiratory protection device according to the present disclosure including a mask body having first and second chambers and a shut-off valve in a closed position.

Shut-off valve 250 may be manually operated to switch between an open position (FIG. 2*c*) and a closed position (FIG. 2*d*). In an exemplary embodiment, actuator 251 is a button, such as an over-molded elastomeric button, that may be pressed inward by a wearer to cause sealing pad 252 to move towards fluid intake communication component 240 until sealing pad 252 contacts sealing surface 246. In an open position shown in FIG. 2*c*, air may pass through inhalation port 241 into the breathable air zone defined by second chamber 222 if allowed by diaphragm or flap 243. In a closed position shown in FIG. 2*d*, sealing pad 252 is in sealing engagement with sealing surface 246 to prevent air from passing through inhalation port 241. When actuator 251 is released by a wearer, actuator 251 returns to an open position due to a resilient member that biases sealing pad 252 away from sealing engagement with sealing surface 246.

In an exemplary embodiment, an actuator 251 in the form of an elastomeric button acts as a resilient member that biases sealing pad towards an open position away from sealing engagement with sealing surface 246. Actuator 251 may include a flexible web 256 attached to outer wall 223 (FIGS. 2*a*, 2*b*) of mask body 220 to support actuator 251 and/or bias shut-off valve 250 to an open position. The web is formed of a flexible or compliant material that is able to elastically deform when actuator 251 is pressed inwardly by a wearer, as shown in FIG. 2*d*, for example. In a closed position, flexible web 256 is flexed and/or deformed allowing sealing pad 252 to travel towards sealing surface 246. Flexure and/or deformation of flexible web 256 is desirably limited to the elastic regime such that flexible web 256 is able to repeatedly return to an original configuration in which shut-off valve 250 is in an open position.

Other resilient members may be provided in place of or in addition to a flexible web. In various exemplary embodiments, a coil spring, leaf spring, elastomeric band, or other suitable resilient member as known in the art may be provided to bias actuator 251 and sealing pad 252, to an open position. Alternatively or in addition, a spring loaded member may be provided on a surface of sealing pad 252 to bias actuator 251, and shut-off valve 250, away from sealing surface 246 and towards an open position. In some exemplary embodiments, a coil spring 259 is provided around shaft 254 to bias actuator 251 and sealing pad 252 away from sealing surface 246 and into an open position. A coil spring may provide a force to bias actuator 251 and sealing pad 252 in place of or in addition to one or more additional resilient members, such as the elastomeric web described above.

In an exemplary embodiment, actuator 251 is attached to mask body 220 such that a seal is formed between actuator 251 and mask body 220, for example by over-molding the actuator on mask body 120. Other suitable seal may be provided using gaskets, flanges, adhesive, interference fits, molding techniques, sonic welding, and other suitable techniques as known in the art such that air and contaminants from the external environment are unable to enter mask body 220 proximate actuator 251. The presence of an adequate seal preventing ingress of air and contaminants from the external environment is desirable because the volume surrounding the portions of shut-off valve 250 internal to mask body 220 is in fluid communication with breathable air zone 222. A sufficient seal proximate actuator 251 thus protects the breathability of air in breathable air zone 222 when shut-off valve 250 is in an open, closed, or intermediate position.

Fluid intake communication component 240 and shut-off valve 250 are configured to minimize a negative effect on pressure drop that could interfere with a wearer's ability to breath freely. In various exemplary embodiments, sealing pad 252 is positioned between 8 mm and 1 mm, 6 mm and 2 mm, or about 3 mm from sealing surface 246 when shut-off valve 250 is in an open position. That is, sealing pad 252 travels between approximately 8 mm and 1 mm from an open position to a closed position. Such a distance provides a shut-off valve that may be relatively compact while providing sufficient space for air to pass through when in an open position.

In various exemplary embodiments, shut-off valve 250 may remain in a closed position due to a negative pressure within the mask. That is, while performing a negative pressure fit check, a wearer may move actuator 251 to a closed position by pressing inward on actuator 251, inhale, and then release actuator 251. After a wearer releases actuator 251, the resilient member may not overcome the negative pressure within second chamber 222 acting on sealing pad 252 resulting from inhalation by the wearer. Shut-off valve 250 may thus remain in a closed position until the wearer exhales or the pressure within second chamber 222 is no longer sufficient to overcome the force of the resilient member. A resilient member that allows shut-off valve 250 to remain in a closed position even after actuator 251 is released by a wearer may allow for a more accurate fit check because the wearer is not applying a force on actuator 251 that could affect the seal between mask body 220 and the wearer's face. However, even while the resilient member allows shut-off valve 250 to remain in a closed position due to negative pressure within a breathable air zone of mask body 220, the shut-off valve may automatically return to an open position without further input to actuator 251 by the wearer. An increase in pressure within the mask body, resulting from exhalation of the wearer, for example, may result in the shut-off valve 250 returning to an open position in which the wearer may breathe freely. Such a feature allows a wearer to safely breathe without further input to actuator 251 to return shut-off valve 250 to an open position.

U.S. application Ser. No. 13/757,373, titled Respirator Negative Pressure Fit Check Devices and Methods and filed on the same date herewith, addresses various embodiments of a respiratory protection device including negative pressure fit check features, and is incorporated herein by reference.

A mask body according to the present disclosure provides several advantages. A mask body having a first and second chamber allows a first chamber to deliver air to a desired location while two or more breathing air sources may be positioned in an ergonomically desirable manner. Components of a respiratory protection device may be advantageously positioned independently of inlet ports, such that, for example, a communication component may be positioned in a desirable location relative to the mouth of a wearer. Additionally, multiple breathing air sources may be provided while only a single fluid intake communication component, such as an inhalation valve, is required. The present disclosure thus provides a more robust mask body having reduced complexity and manufacturing costs. Furthermore, a mask body according to the present disclosure facilitates use of a shut-off valve that may be used to perform a negative pressure fit check to provide an indication of an adequate seal around the periphery of the mask body. A respiratory mask according to the present disclosure thus provides a solution to closing inlet valves that were inaccessible and not easily closed in many prior devices, for example. Accordingly, the present design allows greater flexibility and efficacy in delivering and exhausting air from the breathable air zone of a mask than prior designs. A mask body as described herein may be suitable for half-face respirators, full-face respirators, powered or positive pressure respirators, and other suitable respiratory protection devices.

The foregoing detailed description and examples have been given for clarity of understanding only. No unnecessary limitations are to be understood there from. It will be apparent to those skilled in the art that many changes can be made in the embodiments described without departing from the scope of the disclosure. Any feature or characteristic described with respect to any of the above embodiments can be incorporated individually or in combination with any other feature or characteristic, and are presented in the above order and combinations for clarity only. Thus, the scope of the present disclosure should not be limited to the exact details and structures described herein, but rather by the structures described by the language of the claims, and the equivalents of those structures.

What is claimed is:

1. A respiratory mask, comprising:

a mask body defining first and second chambers and having first and second inlet ports adapted to receive first and second breathing air source components;

a fluid intake communication component; and a shut-off valve in fluid communication with the first and second chambers and operable between an open position and a closed position, wherein the shut-off valve is configured to prevent fluid communication between the first chamber and the second chamber when in the closed position, wherein the first chamber is in fluid communication with the first and second inlet ports and the second chamber defines a breathable air zone for a wearer, and wherein the fluid intake communication component is configured to allow communication of air from the first chamber to the second chamber through an inhalation port during inhalation by a wearer.

2. The respiratory mask of claim 1, wherein the fluid intake communication component comprises a diaphragm capable of moving between an open position and a closed position.

3. The respiratory mask of claim 2, wherein the fluid intake communication component comprises a sealing surface, and the diaphragm is in the closed position and biased towards the sealing surface in the absence of a negative pressure within the second chamber, and the diaphragm is in the open position to allow air to enter the second chamber from the first chamber during inhalation by a wearer.

4. The respiratory mask of claim 1, wherein the mask body further comprises an inner wall dividing the first chamber from the second chamber.

5. The respiratory mask of claim 4, wherein the fluid intake communication component is positioned on the inner wall.

6. The respiratory breathing mask of claim 1, further comprising first and second filter cartridges attached to the mask body at the first and second inlet ports.

7. The respirator breathing mask of claim 6, wherein the filter cartridges each comprise a housing in which a filter element is contained.

8. The respiratory mask of claim 1, wherein the shut-off valve comprises a sealing pad.

9. The respiratory mask of claim 8, wherein the fluid intake communication component comprises an inhalation port and a sealing surface surrounding the inhalation port, and the sealing pad contacts the sealing surface when the shut-off valve is in the closed position.

10. The respiratory mask of claim 1, wherein the mask body comprises a central axis that divides the mask body into left and right halves and the fluid intake communication component is positioned proximate the central axis.

11. The respiratory mask of claim 1, wherein the first and second inlet ports are in fluid communication with only a single fluid intake communication component.

12. The respiratory breathing mask of claim 1, wherein the mask body comprises cheek portions, and the first and second inlet ports are located proximate the cheek portions.

13. The respiratory mask of claim 1, wherein the mask body further comprises a compliant face contacting portion.

14. The respiratory mask of claim 1, wherein the shut-off valve is sealed within the mask body and does not allow external air to enter the first chamber when in the open position, closed position, or intermediate position.

15. A negative pressure respiratory mask, comprising:

a mask body comprising first and second chambers and first and second inlet ports;

first and second filter cartridges attached to the mask body at the first and second inlet ports;

an inner wall dividing the first chamber from the second chamber;

an inhalation valve positioned on the inner wall at a central portion of the mask body; and a shut-off valve in fluid communication with the first and second chambers and operable between an open position and a closed position, wherein the shut-off valve is configured to prevent fluid communication between the first chamber and the second chamber when in the closed position, wherein the first and second filter cartridges each have an outlet in fluid communication with the first chamber, the second chamber defines a breathable air zone for a wearer, and the inhalation valve allows communication of air from the first chamber to the second chamber during inhalation by a wearer.

16. The respiratory mask of claim 15, wherein the shut-off valve is sealed within the mask body and does not allow external air to enter the first chamber when in an open position, closed position, or intermediate position.

17. The respiratory mask of claim 16, wherein the first and second inlet ports are in fluid communication with only a single fluid intake communication component.

* * * * *